US005454340A

United States Patent [19]

Sivie

[11] Patent Number: 5,454,340

[45] Date of Patent: Oct. 3, 1995

[54] WATER-TIGHT HOPPER ASSEMBLY FOR SELF-UNLOADING MARINE VESSEL

[76] Inventor: Mark J. Sivie, P.O. Box 489, Kelleys Island, Ohio 43438

[21] Appl. No.: 179,792

[22] Filed: Jan. 11, 1994

[51] Int. Cl.[6] ..... B63B 25/02

[52] U.S. Cl. ..... 114/73; 414/142.2

[58] Field of Search ..... 114/26, 27, 36, 114/37, 73, 34; 414/142.1, 142.2, 142.3, 142.4, 140.2

[56] References Cited

U.S. PATENT DOCUMENTS

| | | | |
|---|---|---|---|
| 2,969,083 | 1/1961 | Joyce | 114/73 |

FOREIGN PATENT DOCUMENTS

| | | | |
|---|---|---|---|
| 0119589 | 10/1978 | Japan | 114/36 |
| 0102785 | 8/1979 | Japan | 114/36 |
| 0672603 | 5/1952 | United Kingdom | 114/36 |

*Primary Examiner*—Sherman Basinger
*Attorney, Agent, or Firm*—Fay, Sharpe, Beall, Fagan, Minnich & McKee

[57] ABSTRACT

A water-tight hopper assembly for a self-unloading marine vessel of the type that transports bulk cargo includes a hopper chute formed from a plurality of interconnected wall members converging toward one another in the downward vertical direction, a discharge opening connected to the lower end of the hopper chute, a cargo discharge gate mounted at the lower end of the discharge opening, and a water-control gate mounted within the discharge opening. The water-control gate includes a fixed sealing flange depending inwardly from the plate members forming the discharge opening and a seal member pivotally connected to the sealing flange. The seal member is movable between a closed position and an open position, the seal member cooperating with the sealing flange to prevent passage of water through the discharge opening while in its closed position. The seal member is locked in its closed position by latching dogs pivotally mounted on the exterior of the discharge opening. A portion of each latching dog passes through a slot formed in the discharge opening to contact the seal member when the seal member is in its closed position. A drop bolt mechanism secures each latching dog in its latching position and urges the seal member into sealing cooperation with the sealing flange. A closure wedge mounted on an edge of the seal member extends through the discharge opening when the seal member is in its closed position.

25 Claims, 5 Drawing Sheets

WATER-TIGHT HOPPER ASSEMBLY FOR SELF-UNLOADING MARINE VESSEL

BACKGROUND OF THE INVENTION

This invention is directed generally to the art of self-unloading marine vessels and, more particularly, to self-unloading barges that contain hoppers for discharging bulk cargo. Examples of bulk cargo include stone, sand, coal, and taconite.

Conventional self-unloading bulk-cargo barges that operate, for example, in the Great Lakes have a plurality of hoppers that are loaded from above with the bulk material to be transported. The hoppers are arranged in one or more rows parallel to the keel of the barge, and a conveyor system is located beneath each row of hoppers in the hold of the barge. At the bottom of each hopper is a cargo discharge gate designed to prevent passage of the cargo out of the bottom of the hopper until the barge reaches its destination and unloading begins.

When the barge is to be unloaded at its destination, the cargo discharge gates are opened, permitting the bulk cargo to be discharged by gravity from the hoppers onto the conveyor system below. The conveyor system in the hold of the barge typically transports the cargo being discharged from the hoppers to an above-deck unloading station via a series of ramps.

Conventional cargo discharge gates are not capable of preventing water that down-floods into a hopper from flowing out of the bottom of the hopper. Thus, some means must be employed to prevent heavy seas and rainfall from entering the hoppers, passing through the cargo discharge gates, and entering the void spaces and machinery spaces of the barge, where the water possibly could flood compartments and de-stabilize the barge. To protect against such water damage, bulk-cargo barges conventionally are fitted with hatch covers over the hoppers. Typically, each of these hatch covers spans a plurality of hoppers. Each hatch cover is required to provide a weather-tight seal along its peripheral edge to prevent water that splashes on the barge's deck during inclement weather and/or high seas from entering the hoppers.

Although heretofore required for safe operation and compliance with shipping regulations, these hatch covers interfere with the efficient operation of bulk-cargo barges in significant ways. If the necessity for hatch covers could be eliminated, the amount of cargo transported by a barge during each trip could be increased, and the costs of operating such barges could be substantially reduced.

First, the use of hatch covers imposes a weight penalty. Hatch covers are extremely heavy, in part because they must be structurally sound to withstand the stress resulting from water splashing on them during rough sees. In addition, the use of hatch covers usually requires that the barge carry a handling device dedicated to removing and replacing the covers. Typically, a bridge crane operating on rails is used to retract and extend the hatch covers. This crane and its associated support structure also are heavy. The total weight of the hatch covers and associated coamings, decking, stiffeners, crane, and crane rails easily can reach 300–400 short tons. The cargo-carrying capacity of the barge must be reduced by an equal amount.

Moreover, the added weight of the hatch covers and associated structure is concentrated above the center of gravity of the vessel, which also interferes with efficient loading. The weight of these structures increases the height of the vessel's center of gravity and consequently increases the difference between the vessel's center of gravity and its center of buoyancy. When this factor is taken into account in stability calculations, the maximum payload of the vessel must be decreased further.

Hatch covers also limit the volume of cargo that can be loaded into a barge. Particularly for bulk cargo having a relatively low mass density, such as coal, loading must be stopped long before the vessel's maximum load limit is reached to permit the fitment of the hatch covers over the hoppers. If the necessity of hatch covers were eliminated, a barge more often could be loaded to its maximum weight capacity.

Hatch covers also are expensive to purchase as original equipment and are costly to maintain in the requisite weather-tight condition. For one typical barge application having two rows of hoppers, the aggregate area of the hopper tops totals 13,400 square feet. Hatch covers for this barge would require at least that much in sheet steel and would require maintaining a weather-tight seal along a perimeter of about 1500 feet.

In addition, hatch covers significantly add to the operating cost of a bulk-cargo vessel. In addition to the cost of maintaining the crane required for moving the hatch covers, utilization of hatch covers interferes with efficient loading of the vessel. Because covers must be fit over discrete areas of the barge, the loading operation must make a stop when the capacity of each hatch opening is reached. Continuous loading of a bulk-cargo barge without concern for the fitment of hatch covers would take 40–50% less time than the discontinuous loading of a conventional barge.

The present invention is intended to enable safe operation of a bulk-cargo vessel without the use of hatch covers.

The present invention is intended to provide a water-tight seal at the bottom of each hopper of a bulk-cargo vessel, thus enabling the elimination of hatch covers.

Furthermore, the present invention is intended to provide a bulk-cargo vessel with weirs for limiting the amount of water that accumulates in hoppers having water-tight seals at their bottoms when the vessel is operated without hatch covers.

By eliminating the necessity for hatch covers, the present invention offers significant advantages over conventional bulk-cargo vessels. First, the substantial cost of hatch covers and the requisite equipment for moving them is eliminated, reducing the cost of the vessel. Second, eliminating the hatch covers and associated structure and equipment provides for increasing the vessel's load capacity in most instances. Third, the operating costs for loading the vessel are reduced, because the vessel can be loaded on a continuous basis.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

The present invention overcomes the problems of prior art self-unloading bulk-cargo marine vessels by providing water-tight hopper gates to prevent the passage of water from the hoppers to the hold of the vessel, thereby permitting the elimination of hatch covers.

To overcome the problems of the prior art bulk-cargo vessels, and in accordance with the purpose of the invention, as embodied and broadly described herein, the water-tight hopper assembly of this invention is for a self-unloading marine vessel of the type that transports bulk cargo and comprises a hopper chute including a plurality of interconnected wall members and having a discharge opening at the bottom thereof, a cargo discharge gate connected to the discharge opening for controlling discharge of bulk cargo from the hopper chute, and a water-control gate disposed in the discharge opening. The water-control gate includes a seal member movable between a closed position and an open position. The seal member prevents passage of water through the discharge opening while it is in the closed position.

The hopper assembly of this invention also can comprise weir means for limiting the level of water retained in the hopper chute when the seal member of the water-control gate is in its closed position. Preferably, the weir means includes an overflow conduit having one end connected to the hopper chute at a preselected elevation and a second end opening out of an exterior surface of the vessel.

In a preferred embodiment of the invention, the hopper chute includes a plurality of interconnected wall members converging toward one another in a downward vertical direction. Each of the wall members terminates at a lower edge, and the lower edges of the wall members define a substantially rectangular aperture. The discharge opening of the hopper chute has an upper end connected to the hopper chute at the aperture and a lower end. The discharge opening also has a substantially rectangular cross section and includes four interconnected plate members. Each of the plate members depends substantially vertically downward from the lower edge of one of the wall members. In this preferred embodiment, the cargo discharge gate is mounted at the lower end of the discharge opening, and the water-control gate is mounted in the discharge opening above the cargo discharge gate. The water-control gate preferably includes a fixed sealing flange depending inwardly from the plate members of the discharge opening and defining a substantially rectangular sealing surface adjacent the plate members. The preferred seal member is substantially rectangular and cooperates with the sealing flange to prevent passage of water through the discharge opening while in its closed position. The water-control gate also preferably includes means for locking the seal member in its closed position. Preferably, the water-control gate further includes a gasket mounted on the sealing flange between the sealing flange and the seal member.

The means for locking the seal member in the closed position preferably includes at least one latching dog pivotally connected to one of the plate members of the discharge opening. The latching dog is pivotable toward the sealing flange into a latching position in contact with said seal member when said seal member is in its closed position. The locking means also includes means for securing the latching dog in its latching position and urging the seal member into sealing cooperation with the sealing flange. Preferably, the dog securing means includes a bolt member pivotally connected to the one plate member of the discharge opening and a nut member threadably engaged with the bolt member. The bolt member is pivotable into a locking position in which the associated nut member is engageable with the latching dog, whereby rotating the nut member relative to the bolt member urges the latching dog toward the sealing flange.

The accompanying drawings, which are incorporated in and which constitute a part of this specification, illustrate at least one embodiment of the invention and, together with the description, explain the principles of the invention.

DESCRIPTION OF THE PREFERRED EMBODIMENT

Reference now will be made in detail to the presently preferred embodiment of the invention, an example of which is illustrated in the accompanying drawings.

Figure 2:
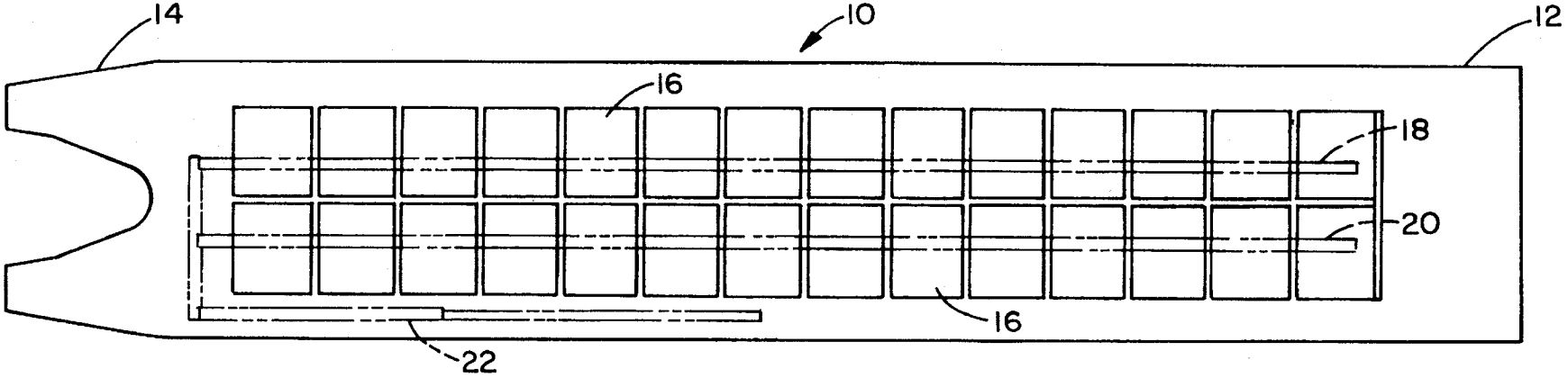
FIG. 2 is a plan view of the barge shown in FIG. 1.
Figure 1:
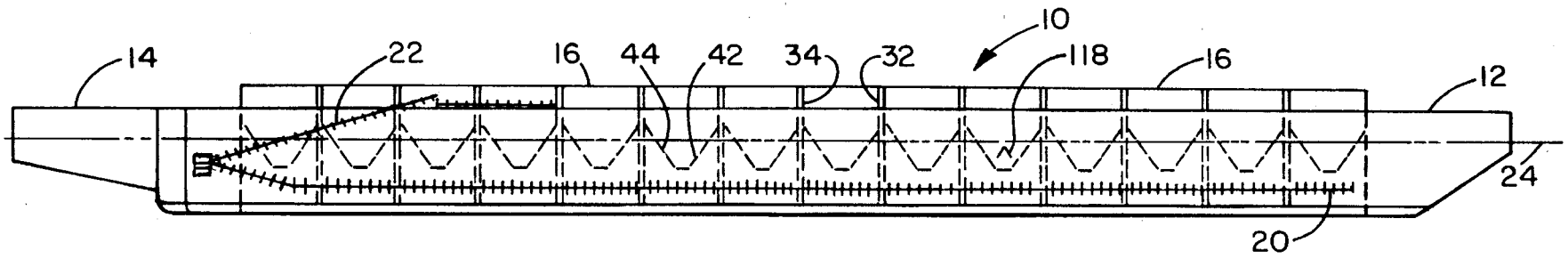
FIG. 1 is schematic elevational view of a bulk-cargo barge of the type with which the present invention is used.

The invention will be described with reference to the self-unloading bulk-cargo barge depicted generally by reference numeral 10 in FIGS. 1 and 2, with the bow 12 to the right and the stern 14 to the left. The invention, however, is applicable to any bulk-cargo marine vessel having one or more hoppers that discharge the bulk cargo downward into the hold of the vessel. Barge 10 includes a plurality of hoppers 16 arranged in two longitudinal rows. As depicted in FIGS. 1 and 2, barge 10 includes two rows of fourteen hoppers.

Barge 10 is self-unloading by virtue of a conveyor system contained in the hold of the vessel. Specifically, the vessel includes a port-side conveyor 18 and a starboard-side conveyor 20, each of which underlies a respective row of hoppers 16. As is well known to those skilled in the art, conveyors 18 and 20 transport material flowing out of the bottoms of hoppers 16 in the aft direction toward the stern 14 of barge 10. The conveyors 18, 20 converge near the stern, and the cargo material is transported via conveyor ramp 22 to the upper deck of barge 10. The bulk cargo then is conveyed in the forward direction to an unloading station (not shown), where it is unloaded from the vessel. As shown in FIG. 1, conveyors 18, 20 and the bottom portions of hoppers 16 are positioned below water line 24 of barge 10.

Figure 3:
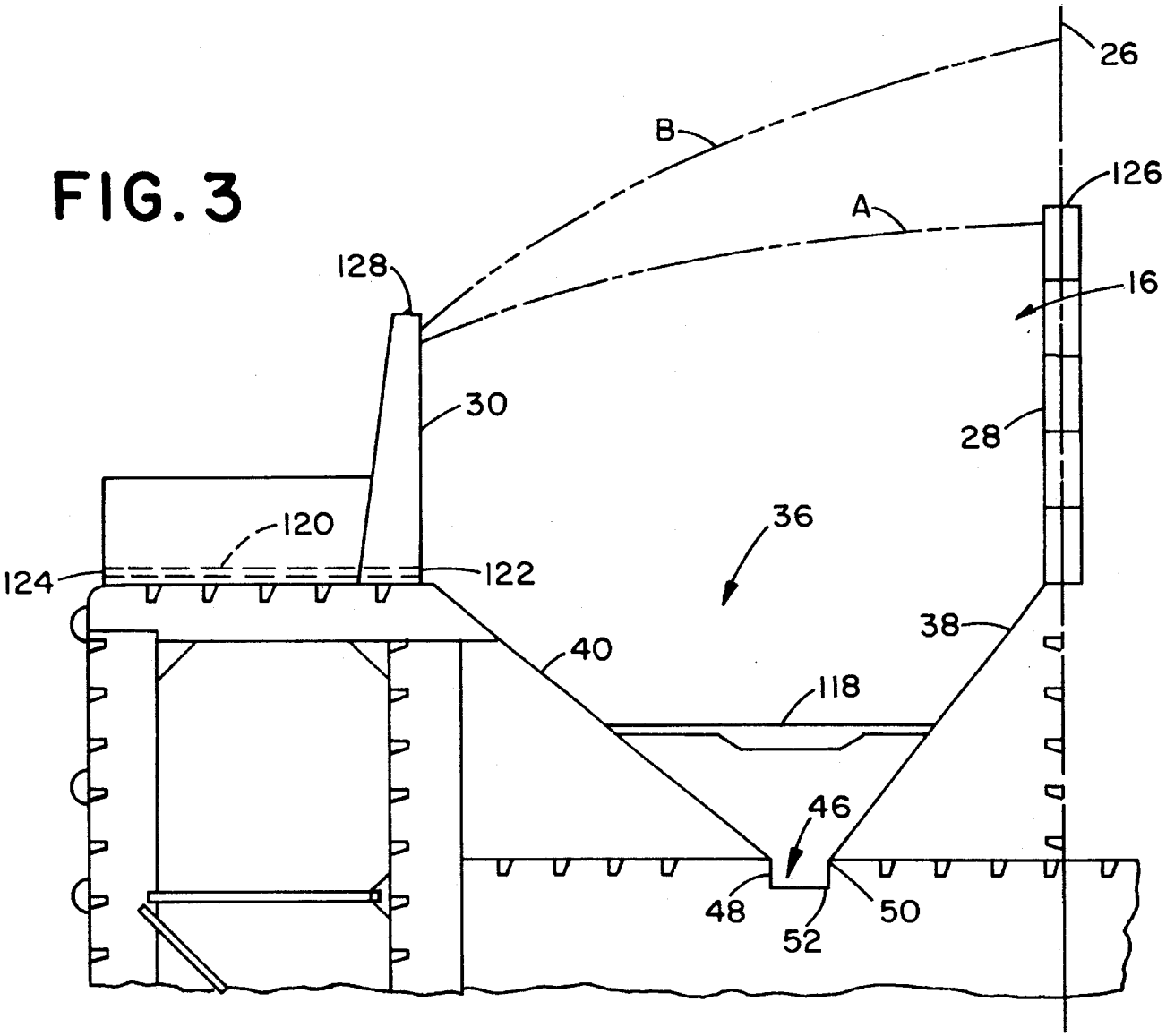
FIG. 3 is partial cross-sectional view of the barge shown in FIGS. 1 and 2, looking in the aft direction and showing a starboard-side hopper.

Reference now will be made to FIG. 3, which is a partial cross-sectional view of barge 10, looking in the aft direction and showing one of the starboard-side hoppers Barge 10 is essentially symmetrical along center line 26, so that the port-side hopper adjacent the hopper shown in FIG. 3 is essentially a mirror image of that shown.

As will be appreciated by those skilled in the art, hopper 16 is generally of conventional construction, with the majority of the hopper's volume consisting of a box-shaped space enclosed by center wall surface 28, side wall surface 30, and forward and aft wall surfaces 32, 34 (see FIG. 1). Further in accordance with conventional construction of bulk-cargo barges, a hopper chute 36 extends downwardly from the portion of hopper 16 defined by wall surfaces 28, 30, 32, 34. Hopper chute 36 is constructed of four interconnected wall members: center wall member 38, side wall member 40, and forward and aft wall members 42, 44 (see FIG. 1). The wall members of the hopper chute converge toward one another in a downward vertical direction, with each wall member terminating at a lower edge. The lower edges of the four wall members 38, 40, 42, 44, define a substantially rectangular aperture 46.

Figure 4:
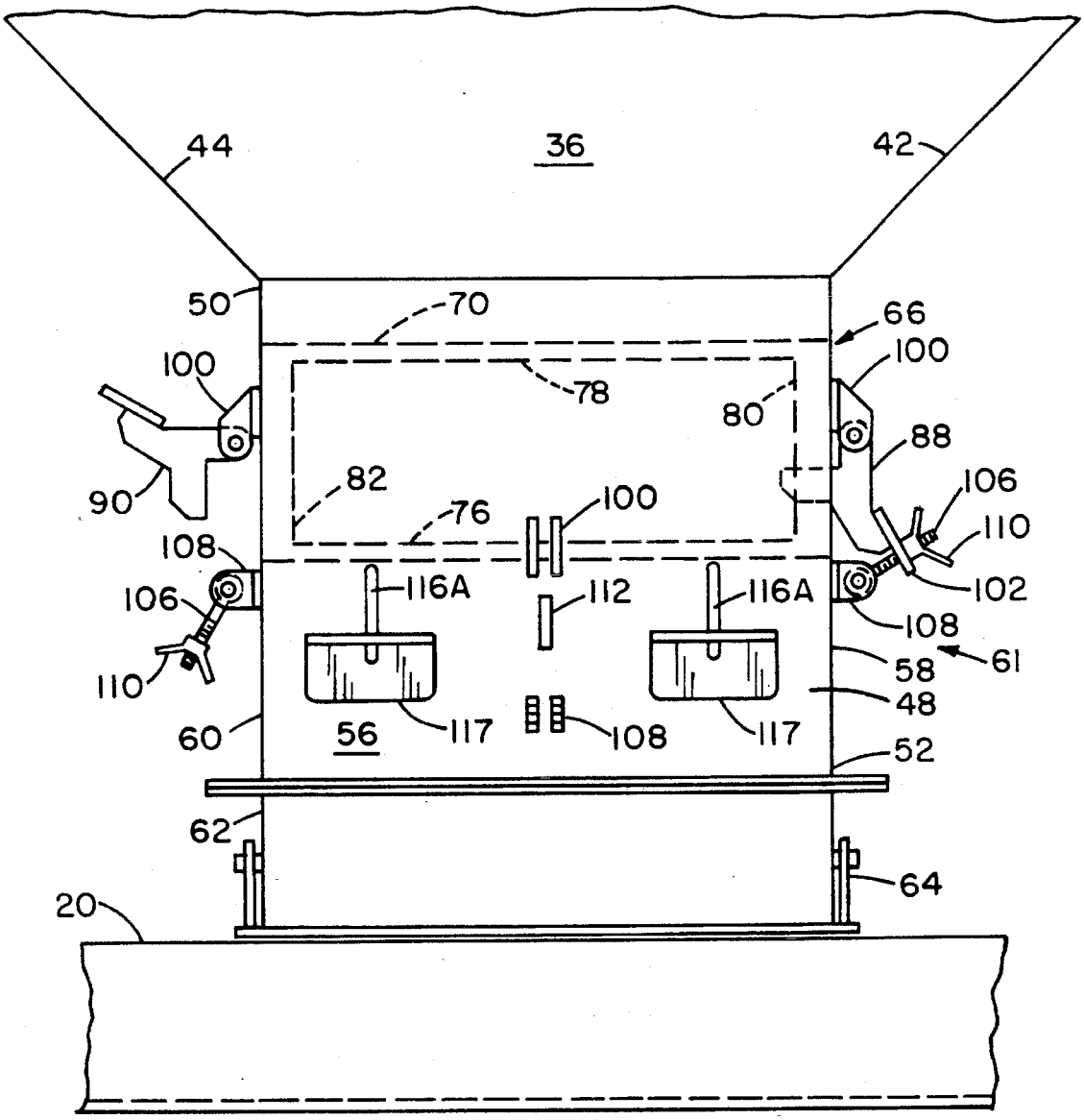
FIG. 4 is an elevational view of the hopper assembly of the present invention applied to the hopper shown in FIG. 3, viewed from the starboard side.
Figure 6:
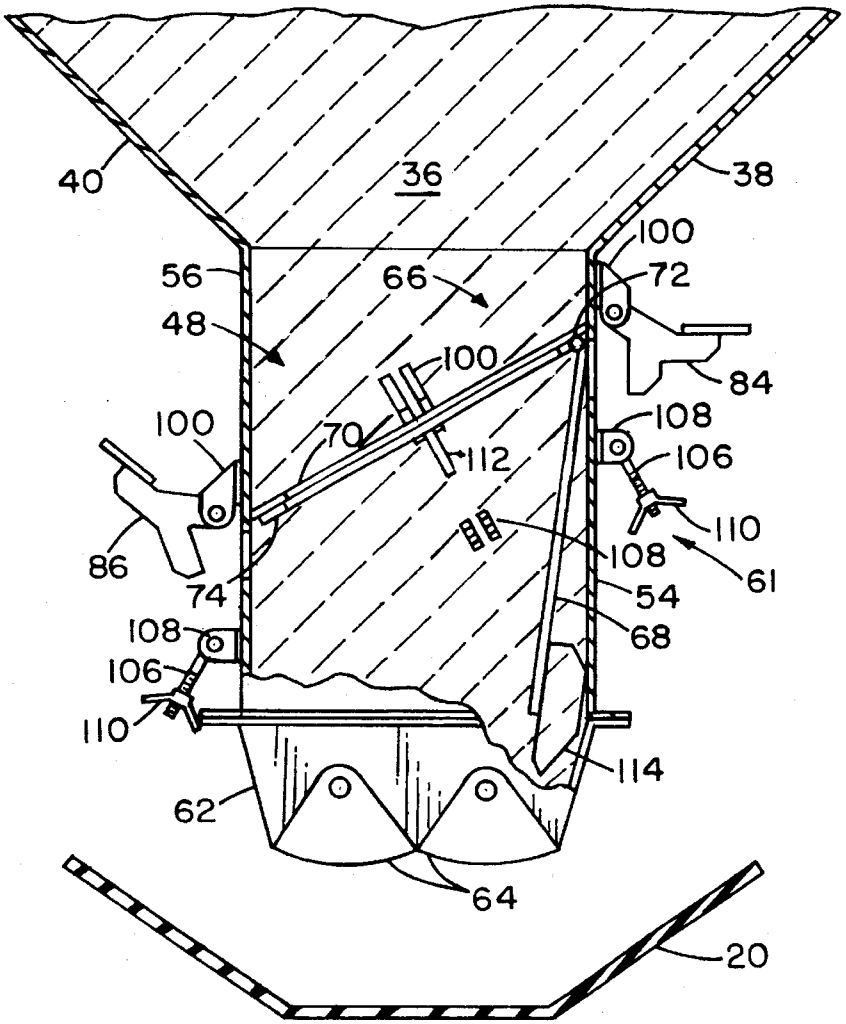
FIG. 6 is a partially cut-away elevational view of the hopper assembly of the present invention applied to the hopper shown in FIG. 3, viewed from the forward side and showing the water-tight gate in the open position.
Figure 5:
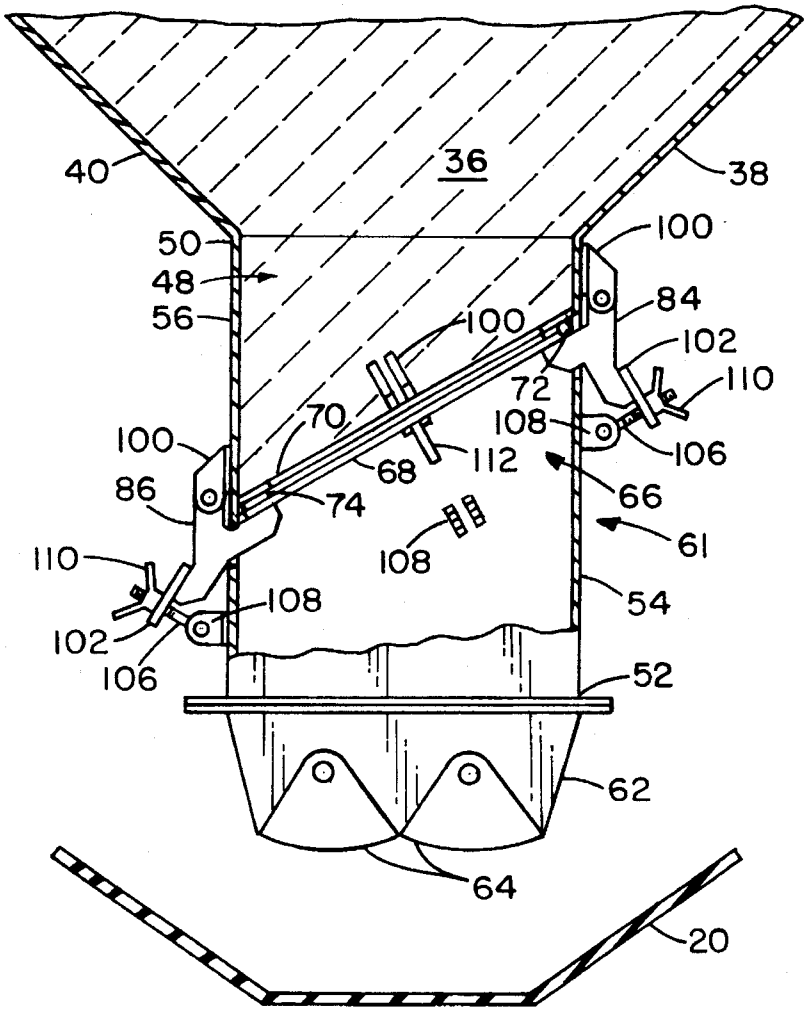
FIG. 5 is a partially cut-away elevational view of the hopper assembly of the present invention applied to the hopper shown in FIG. 3, viewed from the forward side and showing the water-tight gate in the closed position.

The hopper assembly of the present invention includes a discharge opening at the bottom of hopper chute 36. As shown in FIG. 3, discharge opening 48 has an upper end 50 connected to hopper chute 36 at aperture 46 and a lower end 52. As shown in FIGS. 4–6, discharge opening 48 has a substantially rectangular cross-section and includes four interconnected plate members 54, 56, 58, and 60. Each of these plate members depends substantially vertically downward from the lower edge of one of the wall members forming hopper chute 36.

The hopper assembly of this invention also includes a water-tight hopper gate 61. In accordance with the invention, hopper gate 61 includes a cargo discharge gate connected to the discharge opening for controlling discharge of bulk cargo from hopper chute 36. In the preferred embodiment shown in FIGS. 4–6, a clamshell-type cargo discharge gate 62 is mounted at the lower end 52 of discharge opening 48. Cargo discharge gate 62 includes a pair of clamshell doors 64, which are shown in their closed positions in FIGS. 5 and 6.

To provide water-tight operation in accordance with the invention, hopper gate 61 includes a water-control gate 66 disposed in discharge opening 48. Water-control gate 66 includes seal member 68, preferably a rectangular steel plate, which is movable between a closed position and an open position. The seal member prevents passage of water through the discharge opening while in its closed position. Although water-control gate 66 is positioned above cargo discharge gate 62 in the drawings, it is possible to locate the water-control gate beneath the cargo discharge gate without departure from the invention.

Preferably, water-control gate 66 includes a fixed sealing flange 70 mounted within discharge opening 48. The sealing flange 70 depends inwardly from each of plate members 54, 56, 58, 60 of discharge opening 48 and defines a substantially rectangular sealing surface adjacent the interior sides of the plate members. Seal member 68 preferably is pivotally connected to sealing flange 70 via hinge 72 so that seal member 68 pivots about hinge 72 between the closed position shown in FIG. 5 and the open position shown in FIG. 6. When seal member 68 is in its closed position as shown in FIG. 5, it cooperates with sealing flange 70 to prevent passage of water through discharge opening 48.

The dashed diagonal lines in FIG. 5 depict the water-tight condition of hopper gate 61 when seal member 68 of water-control gate 66 is in its closed position. In contrast, when seal member 68 is in its open position as shown in FIG. 6, any water (again represented by dashed diagonal lines) in hopper 16 will be free to flow downwardly to cargo discharge gate 62, which typically operates to prevent passage of bulk material only, not water.

In the preferred embodiment of this invention, hopper gate 61 includes a resilient gasket 74 mounted on the underside of the sealing flange 70 to enhance the water-tight seal between the sealing flange and the seal member. The preferred position for the gasket is on sealing flange 70 rather than on seal member 68 to minimize abrasion and other damage to the gasket caused by the bulk cargo flowing through the discharge opening.

As shown in FIGS. 5 and 6, sealing flange 70 preferably is disposed at a non-perpendicular angle to the flow of material through discharge opening 48. Orienting the sealing flange in this manner reduces the angle through which seal member 68 must be pivoted when closing water-control gate 66. As shown in FIG. 4, sealing flange 70 preferably includes first and second horizontal flange sections 76 and 78, which are disposed on opposite plate members 54 and 56 of discharge opening 48. Segments 76 and 78 are connected by first and second angled flange elements 80 and 82, which are disposed on fore and aft plate members 58 and 60, respectively. In the presently preferred embodiment of the invention, segments 80, 82 and the plane defined by flange 70 form an angle of approximately 30° with the horizontal.

In accordance with the invention, water-control gate 66 of hopper gate 61 also includes means for locking the seal member in its closed position. As embodied herein and as shown in FIGS. 4–6, the locking means of this invention includes at least one latching dog pivotally connected to one of the plate members of discharge opening 48 and capable of urging seal member 68 into sealing cooperation with flange 70. In the preferred embodiment, the locking means includes four latching dogs, one pivotally mounted on each plate member of discharge opening 48. Specifically, the preferred locking means includes port-side latching dog 84 pivotally connected to plate member 54, starboard-side latching dog 86 pivotally connected to plate member 56, forward latching dog 88 pivotally connected to plate member 58, and aft latching dog 90 pivotally connected to plate member 60.

Figure 8:
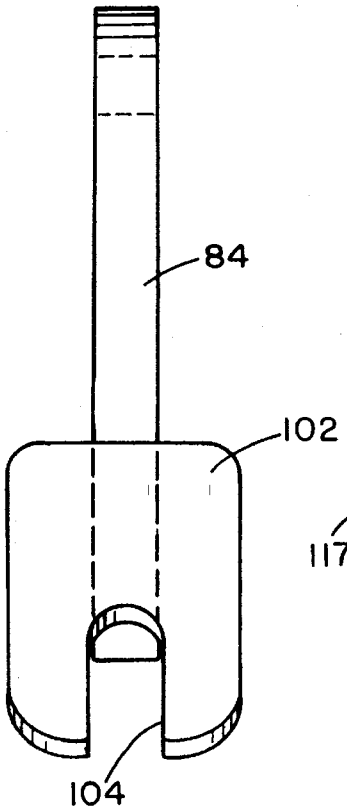
FIG. 8 is a view the latching dog of FIG. 7 taken along line 8—8.
Figure 7:
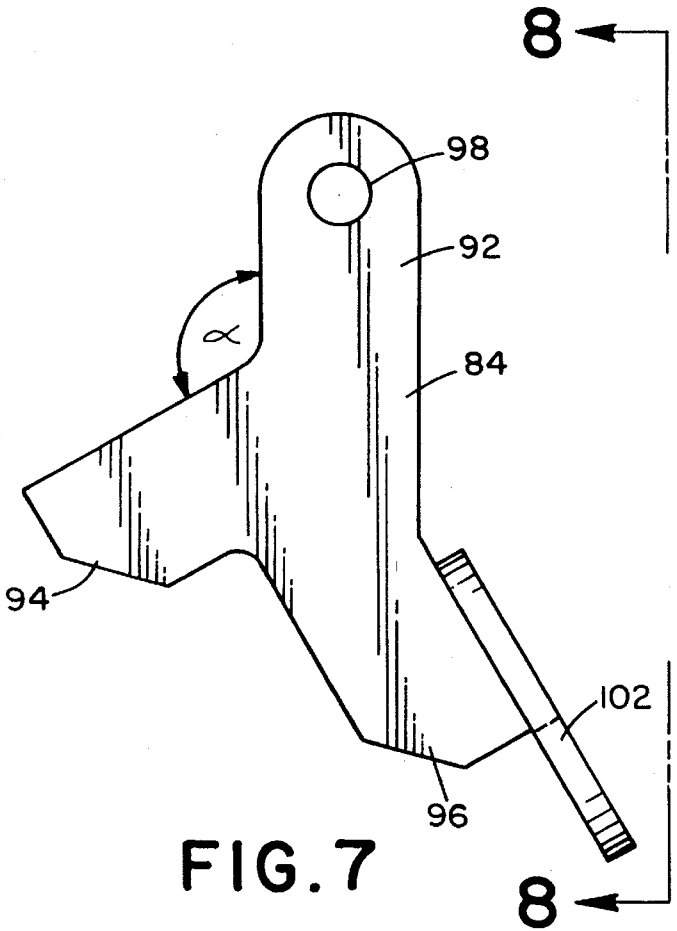
FIG. 7 is a side view of one of the latching dogs of the hopper assembly of the present invention.

With reference to FIGS. 7 and 8, which show detailed views of starboard-side latching dog 84 but are generally representative of all of the latching dogs, each latching dog has three legs: pivot leg 92, clamping leg 94, and locking leg 96. The angle $\alpha$ between pivot leg 92 and clamping leg 94 will vary depending upon the angle assumed by sealing flange 70 and the position of the latching dog. In the embodiment of the invention shown in the drawings, in which flange 70 forms an angle of approximately 30° with the horizontal, $\alpha$ equals 120° for portside latching dog 84, 60° for starboard-side latching dog 86, and 90° for fore and aft latching dogs 88 and 90. The value of $\alpha$ is chosen so that, when the particular latching dog is pivoted to its latching position, the clamping leg 94 engages the underside of the closed sealing plate substantially parallel to the sealing plate, as shown in FIG. 4 with respect to latching dog 88 and as shown in FIG. 5 for latching dogs 84 and 86.

Each latching dog includes a hole 98 at the end of pivot leg 92, which is pivotally connected to a dog hinge 100 mounted on the exterior side of its respective plate member of discharge opening 48. In addition, each latching dog includes a locking plate 102 fixed, preferably by welding, to locking leg 96. Locking plate 102 includes a slot 104 as shown in FIG. 8.

In accordance with the invention, hopper gate 61 also includes means for securing each latching dog in its latching position and urging the seal member into sealing cooperation with the sealing flange. As embodied herein and as shown in FIGS. 4–6, the dog securing means of this invention comprises a drop bolt mechanism, which includes a bolt member 106 pivotally connected to a bolt hinge 108 mounted on each plate member 54, 56, 58, 60, beneath its associated latching dog. A nut member 110 is threaded onto each bolt member 106.

As shown in FIG. 5 and on the forward (right-hand) side of FIG. 4, the drop bolt mechanism secures the latching dog by pivoting bolt member 106 upward into slot 14 of the associated latching dog and threading nut member 11 into engagement with flange 102. The further nut member 110 is threaded toward flange 102, the more the latching dog urges seal member 68 into sealing cooperation with gasket 74 and sealing flange 70. Each latching dog-drop bolt combination thus constitutes a positive closing device that, when actuated, provides a securely locked seal between seal member 68 and sealing flange 70.

To guard against excessive deformation of the seal member by the resulting clamping forces when a high torque is applied to nut member 110, seal member 68 can be reinforced with a striker plate (not shown) welded to its underside along each leg of its peripheral edge. The clamping legs 94 of the latching dogs would then contact the striker plates when pivoted into their latching positions.

As shown in FIGS. 4–6, the latching dogs are mounted on the exterior of discharge opening 48 while seal member 68 is disposed within the discharge opening. To permit latching dogs 84, 86, 88, 90 to pivot into their latching positions and engage their respective clamping legs 94 with the underside of seal member 68, each plate member 54, 56, 58, 60 includes a dog slot 112 to provide access by the latching dog to the interior of discharge opening 48.

Each dog slot 112 is sized and oriented to permit passage of clamping leg 94 of its associated latching dog through the plate member. FIG. 4 shows the positions and orientation of starboard-side dog hinge 100, bolt hinge 108, and dog slot 112, which are associated with latching dog 86 (not shown in FIG. 4). The dog hinge, bolt hinge, and dog slot associated with port-side latching dog 84 have the same orientation as those shown in FIG. 4 but are mounted at a higher position to provide engagement with the hinge-side edge of seal member 68. In FIGS. 5 and 6, the positions of the forward-side dog hinge 100, bolt hinge 108, and dog slot 112 are shown for illustrative purposes. These elements and their associated latching dog 88 (as well as their analogous aft-side components) are oriented at an angle substantially perpendicular to sealing flange 70 to provide proper engagement between latching dogs 88, 90 and seal member 68 when the seal member is in its closed position.

The dog slot on port-side plate member 54 also provides an access opening for pivoting seal member 68 to its closed position. Preferably, the water-control gate 66 is closed by inserting a bar through the hinge-side (port-side in FIGS. 5 and 6) dog slot 112 and manually pushing seal member 68 upwardly into its closed position. As will be apparent to those skilled in the art, a separate slot or hole can be located in plate member 54 to provide access for a closing bar. Moreover, other mechanisms such as a hydraulic ram can be used to close water-control gate 66.

Figure 9:
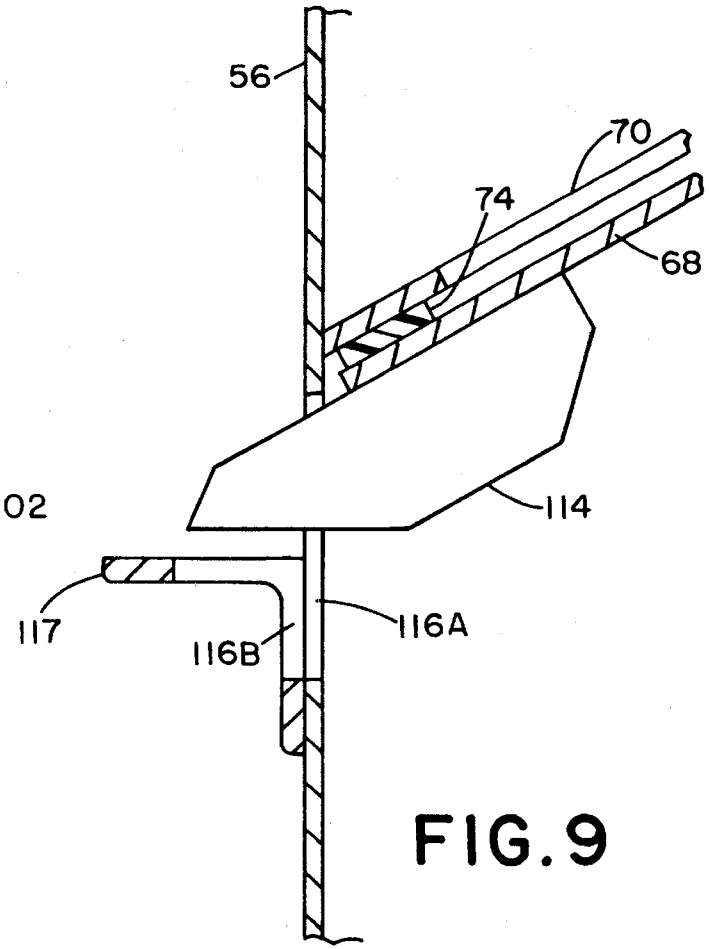
FIG. 9 is a partial cross-sectional view of the hopper assembly of the present invention showing the relative positions of the closure wedge and associated closure angle when the water-control gate of the hopper assembly is closed.

In addition, a pair of closure wedges 114 preferably are mounted on the edge of seal member 68 opposite hinge 72. One of the closure wedges 114 is shown in FIG. 6, which depicts the seal member in its open position. When seal member 68 is in its closed position, as shown in FIG. 9, closure wedges 114 extend through wedge slots 116A formed in starboard-side plate member 56 (see also FIG. 4). An additional pair of wedge slots (not shown) also can be provided near the bottom of plate member 54 to accommodate closure wedges 114 and enable seal member 68 to lie parallel to plate member 54 when the seal member is in its open position.

Further in accordance with the invention and as shown in FIGS. 4 and 9, hopper gate 61 preferably includes a closure angle 117 fixed to plate member 56 at each wedge slot 116A. As shown in FIG. 9, closure angle 117 has a horizontal leg closely spaced from closure wedge 114 when plate member 68 is in its closed position. Each closure angle 117 has a slot 116B formed therein that is aligned with wedge slot 116A to permit passage of closure wedge 114 to the position shown in FIG. 9 when plate member 68 is being pivoted upwardly.

Positive securement of plate member 68 in its closed position can be achieved by driving securing wedges (not shown) into the spaces between closure wedges 114 and closure angles 117. Use of this securement feature also facilitates the opening of water-control gate 66 during discharge. Preferably, the latching dogs 84, 86, 88, 90 are unlocked and pivoted away from their latching positions while the securing wedges are still in place between closure wedge 114 and closure angle 117 to prevent plate member 68 from pivoting downwardly. Water-control gate 66 can then be opened by the single action of removing the securing wedges.

The projection of the closure wedges 114 out of wedge slots 116A also provides a positive indication that seal member 68 is in its closed position and that the water-tight features of water-control gate 66 are in operation. Hopper gate 61 also can be fit with a security system (not shown) that senses the presence or absence of closure wedges 114 extending out through wedge slots 116A in plate member 56. Such a system can call for the illumination of warning lights until wedges 114 extend fully through slots 116A.

Further in accordance with the invention and to assist in minimizing the potential damage to water-control gate 66 from the passage of bulk cargo through discharge opening 48, a deflector angle 118 preferably is connected across hopper chute 36. Preferably, the portion of deflector angle 118 immediately above aperture 46 has an increased width, as shown in FIG. 3.

As is apparent from this disclosure, when seal member 68 is in its closed position, water-control gate 66 provides a water-tight seal at the bottom of hopper 16. Therefore, the necessity for hatch covers is eliminated to the extent that hatch covers are required to prevent water from passing through the hopper and fouling equipment or flooding chambers below the water line of the barge. It is undesirable, however, to permit the entire volume of hopper 16 to become filled with water, as the increased weight would substantially reduce the cargo load limit of the vessel. Therefore, the hopper assembly of this invention includes weir means for limiting the level of water retained in the hopper chute when seal member 68 of water-control gate 66 is in its closed position. As embodied herein and as shown in FIG. 3, the weir means of this invention includes overflow conduit 120 having a first end 122 connected to the hopper chute at a preselected elevation and a second end 124 opening out of an exterior surface of the barge 10. When performing load-limit calculations for a barge equipped with hopper assemblies in accordance with the present invention, the calculations performed for foul weather conditions should assume that each hopper will have water up to the level of the overflow conduit.

The barge structure shown in the drawings and described herein is a barge that was originally constructed to operate with conventional hopper gates and hatch covers. Thus, it is particularly instructive to consider the loading advantages afforded by use of the present invention to provide water-tight hopper gates. With reference to FIG. 3, the starboard-side hatch covers were originally intended to be supported by center support 126 and side support 128. The profile of the maximum volume of bulk cargo that could be loaded into hopper 16 is approximated by double-dashed line A, which would fit beneath a hatch cover spanning the space between supports 126 and 128. When the water-tight hopper assembly of the present invention is employed, however, the necessity of hatch covers is eliminated and hopper 16 can be loaded, for example, up to the profile shown by triple-dashed line B. Indeed, with the elimination of hatch covers, loading of the hoppers can be accomplished without particular consideration of the parameters of the individual hoppers. The only limiting factors essentially are the weight of the cargo and its center of gravity.

It will be apparent to those skilled in the art that other modifications and variations can be made in the apparatus of the invention without departing from the scope of the invention. For example, although the invention has been described with a separate water-control gate and cargo discharge gate, a single seal member can be used to control the flow of both the bulk cargo and any water held in the hopper. Moreover, although a hinged-plate seal member is described herein, other mechanisms such as sliding, rotary, or inflating seal members can be used. In addition, although the present invention is intended to be constructed from structural steel meeting the requirements of the American Bureau of Shipping, other materials can be used without departing from the invention. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A water-tight hopper gate for a self-unloading marine vessel of the type that transports bulk cargo and includes at least one hopper chute and a discharge opening connected to and depending downwardly from the hopper chute, with the discharge opening being formed from interconnected plate members, the hopper gate comprising:

a. a sealing flange fixedly mounted within the discharge opening and depending inwardly from the plate members of the discharge opening, said sealing flange including first and second horizontal flange segments and first and second angled flange segments, said horizontal flange segments being substantially horizontal and disposed opposite one another with said first horizontal flange segment being disposed vertically higher than said second horizontal flange segment, and said first and second angled flange segments being disposed opposite one another and connecting said first an second horizontal flange segments;

b. a seal member pivotally connected to said discharge opening adjacent said first horizontal flange segment of said sealing flange and movable between a closed position and an open position, said seal member cooperating with said sealing flange to prevent passage of water through the discharge opening while in its closed position; and c. means for locking said seal member in its closed position.

2. A water-tight hopper gate for a self-unloading marine vessel of the type that transports bulk cargo and includes at least one hopper chute and a discharge opening connected to and depending downwardly from the hopper chute, with the discharge opening being formed from interconnected plate members, the hopper gate comprising:

a. a sealing flange fixedly mounted within the discharge opening and depending inwardly from the plate members of the discharge opening;

b. a seal member movable between a closed position and an open position, said seal member cooperating with said sealing flange to prevent passage of water through the discharge opening while in its closed position and c. means for locking said seal member in its closed position, said means for locking said seal member including:

at least one latching dog pivotally connected to one of the plate members of the discharge opening, said latching dog being pivotable toward said sealing flange into a latching position in contact with said seal member when said seal member is in its closed position; and means for securing said latching dog in its latching position and urging said seal member into sealing cooperation with said sealing flange.

3. The hopper gate of claim 2, wherein said dog securing means includes a bolt member pivotally connected to the one plate member of the discharge opening and a nut member threadably engaged with said bolt member, said bolt member being pivotable into a locking position in which said associated nut member is engageable with said latching dog, whereby rotating said nut member relative to said bolt member urges said latching dog toward said sealing flange.

4. The hopper gate of claim 1, further comprising a gasket disposed between said sealing flange and said seal member, said gasket enhancing the water-tight seal between said sealing flange and said seal member when said seal member is in its closed position.

5. The hopper gate of claim 4, wherein said gasket is mounted on said sealing flange.

6. A water-tight hopper assembly for a self-unloading marine vessel of the type that transports bulk cargo, comprising:

a. a hopper chute including a plurality of interconnected wall members, said hopper chute having a discharge opening at the bottom thereof;

b. a cargo discharge gate, connected to said discharge opening, for controlling discharge of bulk cargo from said hopper chute; and c. a water-control gate disposed in said discharge opening, said water-control gate including a plate-shaped seal member pivotable between a closed position and an open position, said seal member being oriented substantially non-horizontally while in its closed position and preventing passage of water through said discharge opening while in its closed position.

7. The hopper assembly of claim 6, further comprising weir means for limiting the level of water retained in said hopper chute when said seal member of said water-control gate is in its closed position.

8. The hopper assembly of claim 7, wherein said weir means includes an overflow conduit having one end connected to said hopper chute at a preselected elevation and a second end opening out of an exterior surface of the vessel.

9. A water-tight hopper assembly for a self-unloading marine vessel of the type that transports bulk cargo, comprising:

a. a hopper chute including a plurality of interconnected wall members converging toward one another in the downward vertical direction, each of said wall members terminating at a lower edge, said lower edges of said wall members defining a substantially rectangular aperture;

b. a discharge opening having an upper end connected to said hopper chute at said aperture and a lower end, said discharge opening further having a substantially rectangular cross section and including four interconnected plate members, each of said plate members depending substantially vertically downward from said lower edge of one of said wall members;

c. a cargo discharge gate, mounted at said lower end of said discharge opening, for controlling discharge of bulk cargo from said hopper chute; and d. a water-control gate mounted in said discharge opening above said cargo discharge gate, said water-control gate including:

a sealing flange fixedly mounted within said discharge opening and depending inwardly from said plate members of said discharge opening, said sealing flange including first an second horizontal flange segments and first and second angled flange segments, said horizontal flange segments being substantially horizontal and disposed opposite one another with said first horizontal flange segment being disposed vertically higher than said second horizontal flange segment, and said first and second angled flange segments being disposed opposite one another and connecting said first and second horizontal flange segments; and a substantially rectangular seal member pivotally connected to said discharge opening adjacent said first horizontal flange segment of said sealing flange and movable between a closed position and an open position, said seal member cooperating with said sealing flange to prevent passage of water through said discharge opening while in its closed position.

10. The hopper assembly of claim 9, wherein said water-control gate further includes a gasket disposed between said sealing flange and said seal member, said gasket providing a water-tight seal between said sealing flange and said seal member when said seal member is in its closed position.

11. The hopper assembly of claim 10, wherein said gasket is mounted on said sealing flange.

12. The hopper assembly of claim 9, further comprising weir means for limiting the level of water retained in said hopper chute when said seal member of said water-control gate is in its closed position.

13. The hopper assembly of claim 12, wherein said weir means includes an overflow conduit having one end connected to said hopper chute at a preselected elevation and a second end opening out of an exterior surface of the vessel.

14. A water-tight hopper assembly for a self-unloading marine vessel of the type that transports bulk cargo, comprising:

a. a hopper chute including a plurality of interconnected wall members converging toward one another in the downward vertical direction, each of said wall members terminating at a lower edge, said lower edges of said wall members defining a substantially rectangular aperture;

b. a discharge opening having an upper end connected to said hopper chute at said aperture and a lower end, said discharge opening further having a substantially rectangular cross section and including four interconnected plate members, each of said plate members depending substantially vertically downward from said lower edge of one of said wall members;

c. a cargo discharge gate, mounted at said lower end of said discharge opening, for controlling discharge of bulk cargo from said hopper chute; and d. a water-control gate mounted within said discharge opening above said cargo discharge gate, said water-control gate including:

a sealing flange fixedly mounted within said discharge opening and depending inwardly from the plate members of the discharge opening, said sealing flange including first and second horizontal flange segments and first and second angled flange segments, said horizontal flange segments being substantially horizontal and disposed opposite one another with said first horizontal flange segment being disposed vertically higher than said second horizontal flange segment, and said first and second angled flange segments being disposed opposite one another and connecting said first and second horizontal flange segments;

a substantially rectangular seal member pivotally connected to said discharge opening adjacent said first horizontal flange segment of said sealing flange and movable between a closed position and an open position, said seal member cooperating with said sealing flange to prevent passage of water through said discharge opening while in its closed position; and means for locking said seal member in its closed position.

15. A water-tight hopper assembly for a self-unloading marine vessel of the type that transports bulk cargo, comprising:

a. a hopper chute including a plurality of interconnected wall members converging toward one another in the downward vertical direction, each of said wall members terminating at a lower edge, said lower edges of said wall members defining a substantially rectangular aperture;

b. a discharge opening having an upper end connected to said hopper chute at said aperture and a lower end, said discharge opening further having a substantially rectangular cross section and including four interconnected plate members, each of said plate members depending substantially vertically downward from said lower edge of one of said wall members;

c. a cargo discharge gate, mounted at said lower end of said discharge opening, for controlling discharge of bulk cargo from said hopper chute; and d. a water-control gate mounted within said discharge opening above said cargo discharge gate, said water-control gate including:

a sealing flange fixedly mounted within said discharge opening and depending inwardly from said plate members of said discharge opening;

a substantially rectangular seal member movable between a closed position and an open position, said seal member cooperating with said sealing flange to prevent passage of water through said discharge opening while in its closed position; and means for locking said seal member in its closed position, said means for locking said seal member including:

at least one latching dog pivotally connected to one of said plate members of said discharge opening, said latching dog being pivotable toward said sealing flange into a latching position in contact with said seal member when said seal member is in its closed position; and means for securing said latching dog in its latching position and urging said seal member into sealing cooperation with said sealing flange.

16. The hopper assembly of claim 15, wherein said dog securing means includes a bolt member pivotally connected to said one plate member of said discharge opening and a nut member threadably engaged with said bolt member, said bolt member being pivotable into a locking position in which said associated nut member is engageable with said latching dog, whereby rotating said nut member relative to said bolt member urges said latching dog toward said sealing flange.

17. The hopper assembly of claim 15, wherein:

said one plate member has an interior surface within said discharge opening and an opposed exterior surface;

said latching dog is pivotally connected to said exterior surface of said one plate member; and said one plate member includes a dog slot formed therein, said dog slot being positioned to provide access through said one plate member for said latching dog to make contact with said seal member within said discharge opening.

18. The hopper assembly of claim 14, wherein said seal member has a first edge pivotally connected to said sealing flange and an opposite second edge, and said locking means includes:

at least one closure wedge fixed to said second edge of said seal member; and a closure angle mounted on said plate member of said discharge opening opposite said first edge of said seal member, said closure angle being closely spaced from said closure wedge when said seal member is in its closed position.

19. The hopper assembly of claim 14, further comprising an overflow conduit having one end connected to said hopper chute at a preselected elevation and a second end opening out of an exterior surface of the vessel, said overflow conduit limiting the level of water retained in said hopper chute when said seal member of said water-control gate is in its closed position.

20. A water-tight hopper assembly for a self-unloading marine vessel of the type that transports bulk cargo, comprising:

a. a hopper chute including a plurality of interconnected wall members converging toward one another in the downward vertical direction, each of said wall members terminating at a lower edge, said lower edges of said wall members defining a substantially rectangular aperture;

b. a discharge opening having an upper end connected to said hopper chute at said aperture and a lower end, said discharge opening further having a substantially rectangular cross section and including four interconnected plate members, each of said plate members depending substantially vertically downward from said lower edge of one of said wall members;

c. a cargo discharge gate, mounted at said lower end of said discharge opening, for controlling discharge of bulk cargo from said hopper chute;

d. a water-control gate mounted within said discharge opening above said cargo discharge gate, said water-control gate including:

a sealing flange fixedly mounted within said discharge opening and depending inwardly from said plate members of said discharge opening;

a substantially rectangular seal member movable between a closed position and an open position, said seal member cooperating with said sealing flange to prevent passage of water through said discharge opening while in its closed position;

a latching dog pivotally connected to each of said plate members of said discharge opening, each of said latching dogs being pivotable toward said sealing flange into a latching position in contact with said seal member when said seal member is in its closed position; and a bolt member pivotally connected to each of said plate members of said discharge opening and a nut member threadably engaged with said bolt member, said bolt member being pivotable into a locking position in which said associated nut member is engageable with said latching dog mounted on said respective plate member, whereby rotating said nut member relative to said bolt member urges said latching dog toward said sealing flange; and e. an overflow conduit having one end connected to said hopper chute at a preselected elevation and a second end opening out of an exterior surface of the vessel, said overflow conduit limiting the level of water retained in said hopper chute when said seal member of said water-control gate is in its closed position.

21. A water-tight hopper assembly for a bulk-cargo marine vessel of the type that self-unloads by a conveyor contained in the hold of the vessel, comprising:

a. a hopper chute including a plurality of interconnected wall members, said hopper chute having a discharge opening at the bottom thereof, said discharge opening being disposed above a portion of the conveyor;

b. a cargo discharge gate, connected to said discharge opening, for controlling discharge of bulk cargo from said hopper chute to the conveyor; and c. a water-control gate disposed in said discharge opening, said water-control gate including a seal member movable between a closed position and an open position when said hopper chute contains bulk cargo, said seal member preventing passage of water through said discharge opening into the hold of the vessel while in its closed position.

22. A water-tight cargo handling system for a self-unloading bulk-cargo marine vessel, comprising:

a. a plurality of hopper assemblies contained within the hold of the vessel, each of said assemblies including:

i. a hopper chute including a plurality of interconnected wall members, said hopper chute having a discharge opening at the bottom thereof, ii. a cargo discharge gate, connected to said discharge opening, for controlling discharge of bulk cargo from said hopper chute, and iii. a water-control gate disposed in said discharge opening, said water-control gate including a seal member movable between a closed position and an open position when said hopper chute contains bulk cargo, said seal member preventing passage of water through said discharge opening into the hold of the vessel while in its closed position; and b. a conveyor system contained within the hold of the vessel, a portion of said conveyor system being disposed beneath said hopper assemblies and being adapted to receive bulk cargo discharged through said cargo discharge chutes.

23. A self-unloading bulk-cargo marine vessel, comprising:

a. a hull defining a hold therein;

b. a plurality of hopper assemblies contained within said hold, each of said assemblies including:

i. a hopper chute including a plurality of interconnected wall members, said hopper chute having a discharge opening at the bottom thereof, ii. a cargo discharge gate, connected to said discharge opening, for controlling discharge of bulk cargo from said hopper chute, and iii. a water-control gate disposed in said discharge opening, said water-control gate including a seal member movable between a closed position and an open position when said hopper chute contains bulk cargo, said seal member preventing passage of water through said discharge opening into said hold while in its closed position; and c. a conveyor system contained within said hold, a portion of said conveyor system being disposed beneath said hopper assemblies and being adapted to receive bulk cargo discharged through said cargo discharge chutes.

24. The vessel of claim 23, further comprising weir means for limiting the level of water retained in said hopper chutes when said seal members of said water-control gates are in their closed positions.

25. The vessel of claim 23, wherein:

said hopper chutes remain uncovered while the vessel transports bulk cargo contained in said hopper chutes; and said water control gates prevent water entering said uncovered hopper chutes during transport from passing through said water-control gates into the portion of said hold beneath said water-control gates.

* * * * *